US007596908B2

(12) United States Patent
Rothe et al.

(10) Patent No.: US 7,596,908 B2
(45) Date of Patent: Oct. 6, 2009

(54) ENGAGING PIECE FOR WINDOW REGULATOR

(75) Inventors: Hendrik Rothe, Mömbris-Daxberg (DE); Christoph Buchta, Neuried (DE); Harald Wellershaus, Munich (DE)

(73) Assignee: Magna Closures Inc, Newmarket, Ontario (CA)

( * ) Notice: Subject to any disclaimer, the term of this patent is extended or adjusted under 35 U.S.C. 154(b) by 506 days.

(21) Appl. No.: 11/371,858

(22) Filed: Mar. 9, 2006

(65) Prior Publication Data

US 2006/0174543 A1 Aug. 10, 2006

(51) Int. Cl.
*E05F 11/48* (2006.01)

(52) U.S. Cl. ..... 49/374; 49/352; 49/349

(58) Field of Classification Search ..... 49/348, 49/349, 352, 375, 374
See application file for complete search history.

(56) References Cited

U.S. PATENT DOCUMENTS 4,848,032 A * 7/1989 Ballor et al. ..... 49/350
5,622,005 A * 4/1997 Ochenski et al. ..... 49/375
6,453,617 B1 * 9/2002 Klippert et al. ..... 49/375
6,460,296 B1 * 10/2002 Arquevaux ..... 49/375
6,854,213 B2 * 2/2005 Galliani ..... 49/375
2002/0073622 A1 * 6/2002 Davis ..... 49/349
2006/0037248 A1 * 2/2006 Castellon ..... 49/374

FOREIGN PATENT DOCUMENTS

DE 43 21 616 A1 1/1995

OTHER PUBLICATIONS

English Abstract of DE 4321616.

* cited by examiner

*Primary Examiner*—Gregory J. Strimbu
(74) *Attorney, Agent, or Firm*—Clark Hill PLC

(57) ABSTRACT

A driver (4, 5) of a window lift mechanism to simplify subsequent adjustment of a window pane. The driver (4, 5) includes a flat receiving fork (7) having first and second sides (9, 10). A screw (14) extends through the receiving fork (7) for pulling the first and second sides (9, 10) together. In the vicinity of the axis of the screw (14), the first side (9) includes a number of openings (19). A pressure piece (13), which can be operated from outside of the first side (9), protrudes through the openings (19) into a gap (8) between the first and second sides (9, 10). The pressure piece (13) can be displaced in a substantially parallel direction to the axis of the screw (14). A threaded nut (11) contacts the pressure piece (13) to operate the pressure piece (13).

9 Claims, 6 Drawing Sheets

ENGAGING PIECE FOR WINDOW REGULATOR

BACKGROUND OF THE INVENTION

1. Field of the Invention

The present invention relates to a driver for connecting a window pane to a window lift mechanism. The invention furthermore relates to a window lift mechanism comprising such a driver.

2. Description of the Related Art

The prior art discloses side windows in vehicles, which may be opened by pulling the window pane downward into a pocket-like recess. Such windows typically comprise a window lift mechanism both for guiding and for operating the window pane. In conventional window lift mechanisms, the window pane is retained by drivers, which are disposed displaceably on guide rails extending in the direction of movement of the window pane. This is disclosed, for example, in DE 43 21 616 A1.

The previously known window lift mechanisms, as well as the drivers disclosed therein, however, are associated with disadvantages. In particular, it is not possible to detach the mount of the window pane in the drivers after all parts have been completely installed in a vehicle door, for example, in order to perform readjustments.

It is the object of the present invention to create a window lift mechanism as well as drivers for a window lift mechanism, which allow simple realignment of the window pane even following installation in a vehicle door.

SUMMARY OF THE INVENTION

According to one aspect of the invention, there is provided a driver for a window lift mechanism in a vehicle. The driver includes a flat receiving fork and a screw for tightening the sides of the receiving fork. One side in the vicinity of the axis of the screw comprises a number of openings, through which a pressure piece that can be operated from the outside of the side extends into the gap between the sides.

BRIEF DESCRIPTION OF THE DRAWINGS

A preferred embodiment of the present invention will be explained in more detail hereinafter with reference to the embodiments that are schematically illustrated in the figures, wherein.

DETAILED DESCRIPTION OF THE PREFERRED EMBODIMENT

Figure 1:
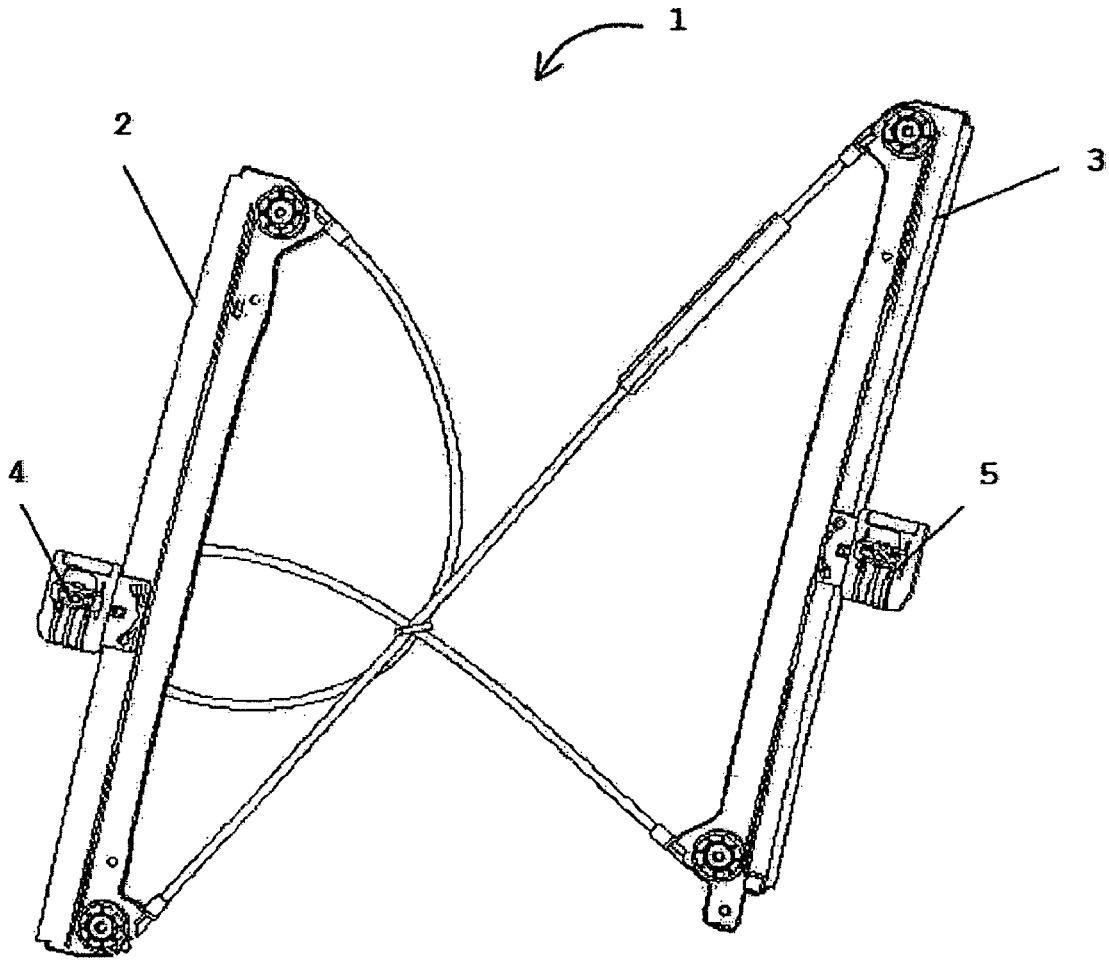
FIG. 1 is a perspective view of a cross-cable window lift mechanism.

According to FIG. 1, a window lift mechanism, and particularly, a cross-cable window lift mechanism 1 comprises two guide rails 2, 3 on each of which a driver 4, 5 is disposed displaceably. The drivers 4, 5 furthermore can be driven along the guide rails 2, 3 via a central drive by connecting them to a common load cable. The drivers 4, 5 serve the connection of a window pane to the window lift mechanism 1. The connection is established in that two lower sections of the window pane are inserted in a slot-shaped orifice of the drivers 4, 5 and are mounted there non-positively. If necessary, it is also conceivable to provide additionally a positive mount with play.

Figure 2:
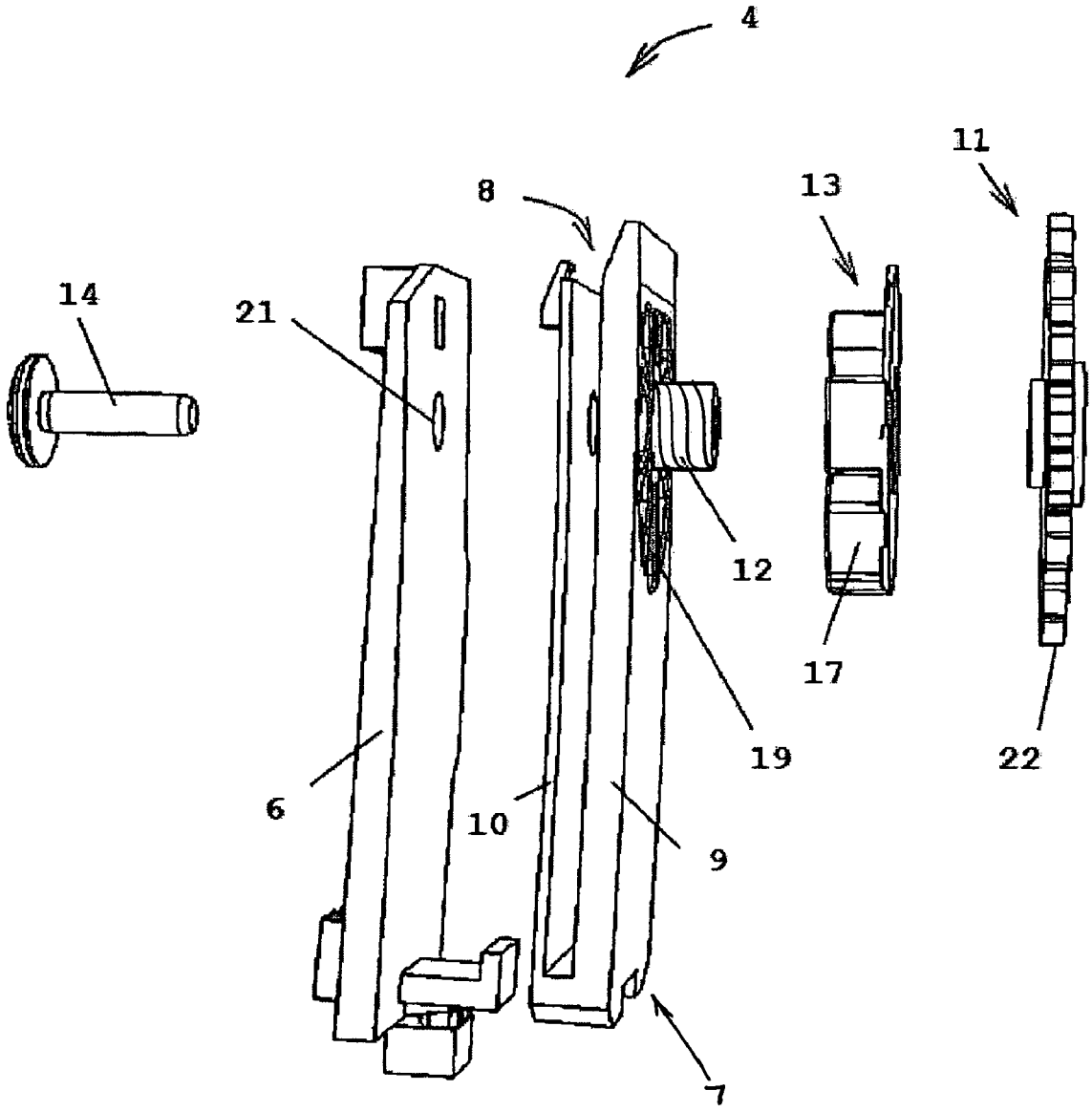
FIG. 2 is an exploded, oblique view of an inventive driver.
Figure 3:
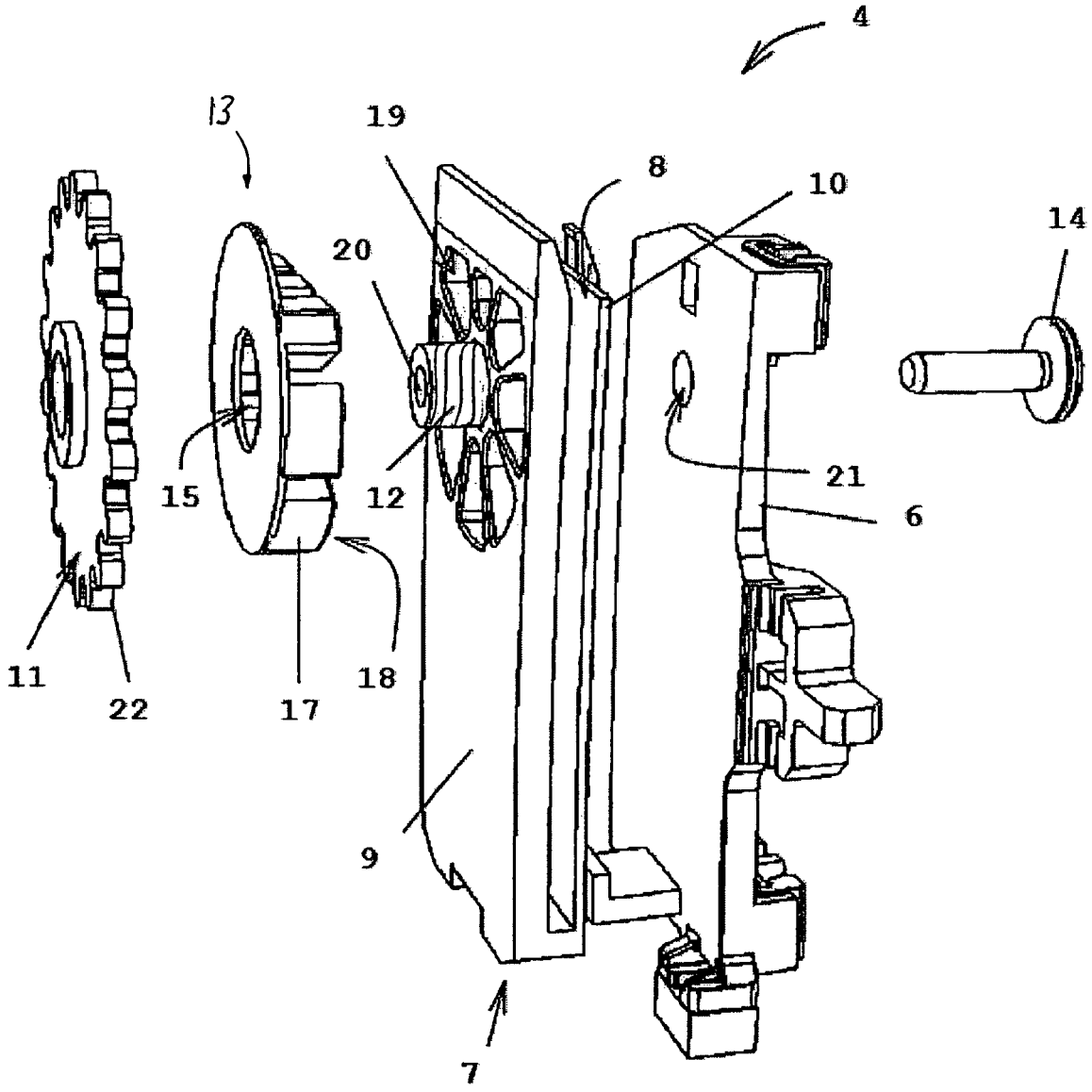
FIG. 3 is another exploded, oblique view of the driver from FIG. 1.
Figure 4:
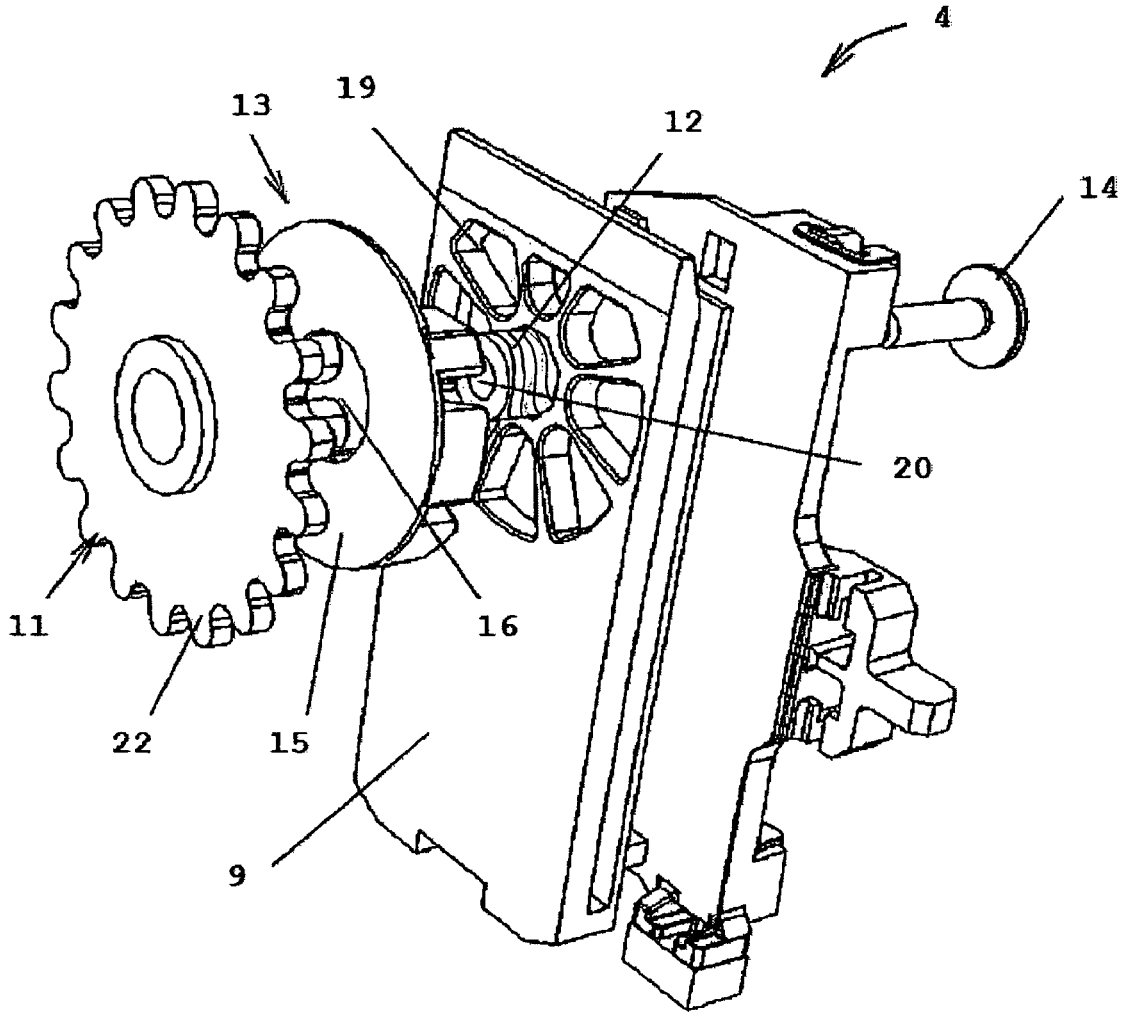
FIG. 4 is another exploded, oblique view of the driver from FIG. 1.
Figure 5:
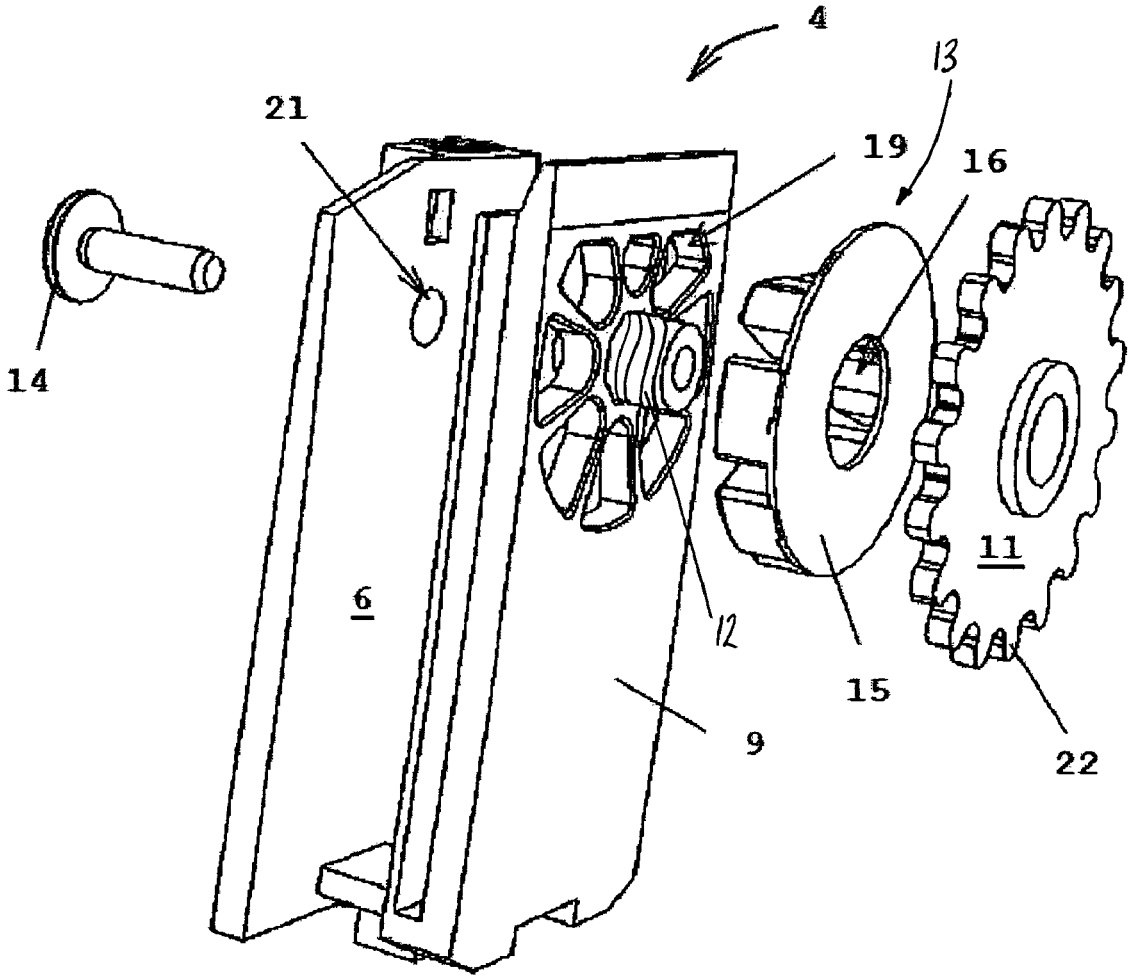
FIG. 5 is yet another exploded view of the driver from FIG. 1.
Figure 6:
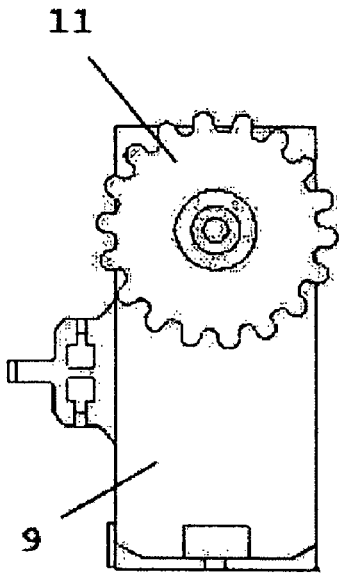
FIG. 6 is a top view of the driver from FIG. 1.
Figure 7:
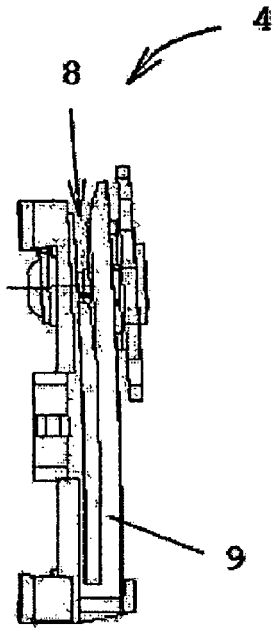
FIG. 7 is a side view of the driver from FIG. 6.
Figure 8:
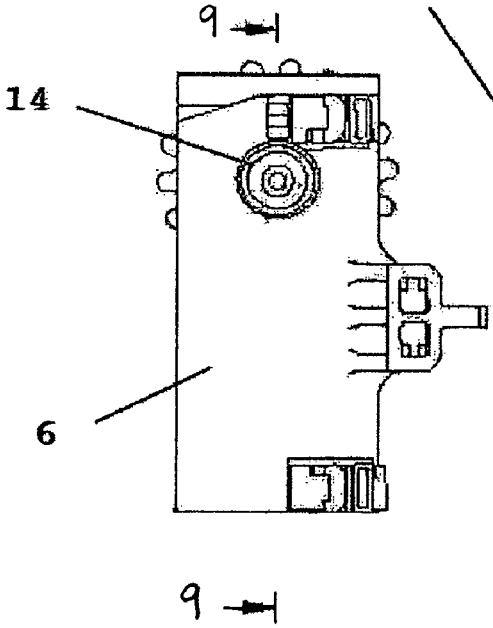
FIG. 8 is a bottom view of the driver from FIG. 1.
Figure 9:
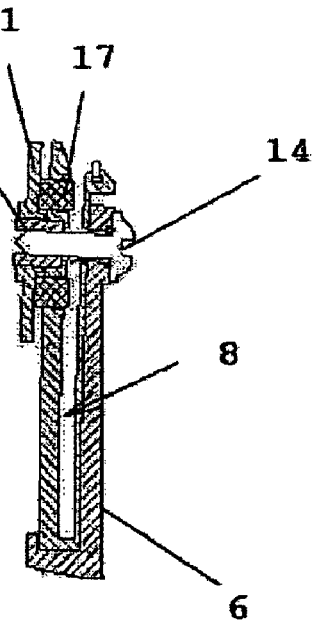
FIG. 9 is a sectional view through the driver from FIG. 1 in the plane 9-9 from FIG. 6.

According to FIGS. 2-4, a driver 4 comprises a base plate 6 with the known means for connecting it to the guide rail 2. A flat receiving fork 7 is connected to the base plate 6. This connection is preferably accomplished with a catch, as illustrated. Alternatively, the receiving fork 7 can also be configured as one piece together with the base body 6. A gap 8 between first and second sides 9, 10 of the receiving fork 7 is dimensioned such that it accommodates the lower section of a window pane. In particular, the width of the gap 8 is dimensioned such that a section of a window pane can be received therein with slight play. In order to fix the window pane section inserted in the gap 8, a threaded nut 11, a threaded sleeve 12, a pressure piece 13 and a screw 14 are provided. The pressure piece 13 includes a section having the shape of a flat circular disk 15 on its back. From an end face of the circular disk 15, substantially prismatic projections 17 protrude on one side in the axial direction. The prismatic projections 17 are preferably distributed around a central orifice 16 of the circular disk 15. Moreover, top sides 18 of the prismatic projections 17 are preferably flat and disposed in one plane, as illustrated in FIGS. 6 and 8. In the first side 9 of the receiving fork 7, openings 19 are provided, through which the prismatic projections 17 of the pressure piece 13 protrude from the outside following the assembly of the driver 4. The threaded sleeve 12 protrudes from the outside into the first side 9 and is held in place corresponding to the central orifice 16 of the circular disk 15 of the pressure piece 13. In the above-described installed position, the pressure piece 13 is retained from the outside of the driver 4 by the threaded nut 11, which is screwed onto the threaded sleeve 12. The threaded sleeve 12 is provided with a bore 20 and preferably a passage, comprising an internal thread at least in some sections. In the second side 10 of the receiving fork 7, a hole 21 is disposed in alignment with the passage of the threaded sleeve 12 for receiving the screw 14. Following the assembly of the driver 4 in accordance with FIGS. 5 and 7, the pressure piece 13 assumes a position in which the prismatic projections 17 protrude slightly on the inside of the first side 9 and hence protrude into the gap 8. In this position, the pressure piece 13 is also secured by the threaded nut 11 against sliding outward. In particular, an end face of the threaded nut 11 comes in contact with the circular disk 15 on the pressure piece 13. The space remaining between the top sides 18 of the prismatic projections 17 and the inside surface of the second side 10 corresponds substantially to the thickness of the window pane that is to be retained. Depending on the application, the threaded nut 11 is preferably knurled or, as illustrated, provided with toothing 22. The toothing 22 may be used later for an assembly tool in order to turn the threaded nut 11.

In this configuration, the driver 4 is equipped for being connected to a window pane. To this end, a perforated, slotted or similarly configured section of the window pane is inserted in the gap 8 of the receiving fork 7 and aligned with its opening with the line of the flush bore 20 in the threaded sleeve 12 and the hole 21 in the second side 10. From the second side 10, the screw 14 is inserted through the hole 21 and the opening in the window pane and then screwed into the threaded sleeve 12. After tightening the screw 14, the window pane is non-positively fixed between the top sides 18 of the prismatic projections 17 on the pressure piece 13 and the inside of the second side 10. If the opening in the window pane is configured as a hole, a positive connection with defined play is achieved after inserting the screw 14.

The described driver 4 allows the window pane to be newly adjusted following assembly without accessing the screw 14, as is explained in the following. This is particularly useful after installing the window lift mechanism in a vehicle door because in this assembly situation frequent access to the head of the screw 14 is practically impossible or at least very difficult. To loosen the non-positive connection between the window pane and the driver 4, a flat tool is applied to the toothing 22 of the threaded nut 11 and the nut 11 is turned such that it moves slightly away from the pressure piece 13. This way, the pressure force, applied by the prismatic projections 17 of the pressure piece 13 on the window pane, decreases. The window pane can now be newly aligned in its position on the driver 4 to the extent that the play provided between the opening in the window pane and the shank of the screw 14 permits. After aligning the window pane, the threaded nut 11 is retightened against the pressure piece 13. The non-positive connection between the driver 4 and the window pane is thus re-established. The pressure piece 13 is optionally self locking. The plurality of openings 19 are optionally substantially shaped as circular ring sectors.

What is claimed is:

1. A driver (4,5) for a window lift mechanism (1) in a vehicle comprising:

a receiving fork (7) including first and second sides (9, 10) defining a gap (8) therebetween, wherein said first side (9) includes a plurality of openings (19) extending therethrough and a sleeve (12) having an externally threaded portion and a threaded bore (20);

a screw (14) extending through said first and second sides (9,10) of said fork (7) and into said threaded bore (20) for tightening said gap (8), said plurality of openings (19) in the vicinity of the axis of said screw (14);

a pressure piece (13) that is operated from outside said fork (7), wherein said pressure piece (13) extends through said plurality of openings (19) into said gap (8); and a threaded nut (11) screwed onto said externally threaded portion of said sleeve (12) to operate said pressure piece (13).

2. The driver (4, 5) according to claim 1, wherein said pressure piece (13) can be displaced in a substantially parallel direction to the axis of said screw (14).

3. The driver (4, 5) according to claim 2, wherein said pressure piece (13) is self-locking.

4. The driver (4, 5) according to claim 3, wherein said pressure piece (13) can be operated by turning said threaded nut (11).

5. The driver (4, 5) according to claim 4, wherein said threaded nut (11) comprises toothing (22) for engagement by an assembly tool to turn said threaded nut (11).

6. The driver (4, 5) according to claim 4, wherein said threaded nut (11) is knurled.

7. The driver (4, 5) according to claim 1, wherein said plurality of openings (19) are disposed in said first side (9) about the axis of said screw (14).

8. The driver (4, 5) according to claim 7, wherein said plurality of openings (19) are substantially shaped as circular ring sectors.

9. The driver (4, 5) according to claim 1, wherein said pressure piece (13) is a round or angular circular disk (15) comprising several prismatic projections (17) that protrude from an end face thereof.

* * * * *